US006149392A

United States Patent [19]

Conte

[11] Patent Number: 6,149,392

[45] Date of Patent: Nov. 21, 2000

[54] GETTER PUMP WITH HIGH GAS SORPTION VELOCITY

[75] Inventor: Andrea Conte, Milan, Italy

[73] Assignee: SAES Getters S.p.A., Milan, Italy

[21] Appl. No.: 09/167,842

[22] Filed: Oct. 7, 1998

[30] Foreign Application Priority Data

Oct. 15, 1997 [IT] Italy ..... MI97 A 002333

[51] Int. Cl.[7] ..... F04B 37/02

[52] U.S. Cl. ..... 417/51

[58] Field of Search ..... 417/48, 51

[56] References Cited

U.S. PATENT DOCUMENTS

| | | | |
|---|---|---|---|
| 3,588,563 | 6/1971 | Schmidt | 417/48 |
| 3,924,967 | 12/1975 | Harra | 417/51 |
| 4,137,012 | 1/1979 | Della Porta et al. | 417/51 |
| 5,221,190 | 6/1993 | Romer et al. | 417/51 |
| 5,320,496 | 6/1994 | Manini et al. | 417/51 |
| 5,324,172 | 6/1994 | Manini et al. | 417/51 |
| 5,980,213 | 11/1999 | Krueger et al. | 417/51 |

FOREIGN PATENT DOCUMENTS

| | | |
|---|---|---|
| 0 719 609 | 3/1996 | European Pat. Off. . |
| 0 753 663 A1 | 1/1997 | European Pat. Off. . |
| 3332606 A1 | 3/1985 | Germany . |
| 3332608 A1 | 3/1985 | Germany . |
| 2077487 | 8/1984 | United Kingdom . |
| WO 94/02957 | 2/1994 | WIPO . |
| WO 94/02958 | 2/1994 | WIPO . |
| WO 96/17171 | 6/1996 | WIPO . |

*Primary Examiner*—Erick R. Solis

*Attorney, Agent, or Firm*—Hickman Stephens Coleman & Hughes, LLP

[57] ABSTRACT

A getter pump with high gas sorption velocity includes a cylindrical housing that has an open end and a closed end and defines a chamber with a central axis. Three to eight getter structures are disposed within the chamber. The getter structures are symmetrically arranged around the central axis of the chamber and are substantially parallel to the central axis of the chamber. Each of the getter structures includes a plurality of porous disks of getter material disposed on a central shaft. A heater is centrally disposed within the chamber such that the heater is substantially coaxial with the central axis of the chamber.

25 Claims, 6 Drawing Sheets

GETTER PUMP WITH HIGH GAS SORPTION VELOCITY

CLAIM FOR PRIORITY

This patent application claims priority under 35 U.S.C. § 119 from Italian Patent Application No. MI97 A 002333, filed Oct. 15, 1997, which is incorporated herein by reference for all purposes.

BACKGROUND OF THE INVENTION

The present invention relates generally to getter pumps and, more particularly, to a getter pump with high gas sorption velocity.

In the field of vacuum technology so-called "getter pumps" have been known for several decades. Getter pumps are static devices, i.e., devices that operate without moving parts. The operation of getter pumps is based on the chemisorption of all gases, except for noble gases, by nonevaporable getter materials, which are sometimes referred to as "NEG materials." The primary NEG materials are titanium-based and zirconium-based alloys.

The active members of getter pumps are referred to as "getter elements." In some getter pumps the getter elements are formed by depositing a layer of getter material having a thickness of less than one millimeter onto generally flat metal supports. These getter pumps are widely used but suffer from the disadvantage that their gas sorption capacity is relatively small because the getter elements contain a relatively small amount of getter material. To overcome this drawback, SAES Getters S.p.A., the assignee of the present application, has recently introduced getter pumps having increased gas sorption capacity in which the getter elements consist of porous bodies formed by sintering powdered NEG material. Examples of such getter pumps are disclosed in U.S. Pat. No. 5,320,496 to Manini et al. and U.S. Pat. No. 5,324,172 to Manini et al., both of which are assigned to SAES Getters S.p.A.

FIG. 1 shows the getter pump disclosed in U.S. Pat. No. 5,320,496 to Manini et al. This pump includes a plurality of getter elements 60 stacked in a cylindrical metal chamber 62. The getter elements 60 occupy the peripheral portion of the chamber while leaving a cylindrical cavity in the center of the chamber. A heater 64 for activating the getter material and maintaining the getter material at its optimal working temperature is provided in the cavity in the center of the chamber.

FIGS. 2*a* and 2*b* show the getter pump disclosed in U.S. Pat. No. 5,324,172 to Manini et al. This pump includes a plurality of rectangular getter elements 70 having broad surfaces 70*a* and narrow surfaces 70*b* disposed in the peripheral portion of a cylindrical metal chamber 72. A heater 74 for activating the getter material and maintaining the getter material at its optimal working temperature is provided in the center of the chamber. As shown in FIG. 2*b*, getter elements 70 are arranged around the center of the chamber such that narrow surfaces 70*b* face heater 74.

The design of the above-described getter pumps shown in the '496 and '172 patents provides high gas sorption capacity. In some applications, however, gas sorption velocity is more important characteristic than gas sorption capacity. The design of the getter pumps shown in the '496 and '172 patents is not conducive to high gas sorption velocity because of reduced gas conductance or inefficient heating of the getter elements. In particular, with reference to FIG. 1, in the getter pump shown in the '496 patent there is reduced gas conductance in the region between the inner wall of housing 62, which defines a chamber, and the stack of getter elements 60. As such, the outermost surfaces of getter elements 60 (relative to the center of the chamber) are not readily accessible to gases in the chamber. Referring now to FIGS. 2*a* and 2*b*, in the getter pump shown in the '172 patent the configuration of rectangular getter elements 70 enables conveyance of gases onto broad surfaces 70*a* and narrow surfaces 70*b* of elements 70. This configuration, however, inefficiently heats getter elements 70 because radiative heat from heater 74 directly contacts substantially only narrow surfaces 70*b*. Thus, the other portions of getter elements 70 are primarily indirectly heated by the conduction of heat within each element. The reduced gas conductance and inefficient heating of the getter elements in the getter pumps shown in the '496 and '172 patents contribute to reduce the frequency with which gas molecules collide effectively with the surfaces of the getter elements that are most peripheral with respect to the center of the pump, thus resulting in reduced overall gas sorption velocity.

Other getter pumps that use getter elements that consist of porous bodies formed by sintering powdered NEG material are known, but these pumps are generally optimized for specific applications. For example, European Patent Publication No. EP 0 753 663 A1 discloses a getter pump in which a set of disk-shaped getter elements are supported on a central mounting having a heater housed therein. This pump is intended for use in portable instruments and, therefore, its design objective is to obtain adequate performance in a small pump with low power requirements for heating the getter elements. This pump does not retain its desirable characteristics when produced with larger dimensions.

International Publication No. WO 96/17171 discloses a getter pump for use in a semiconductor processing chamber. This pump includes a plurality of disk-shaped getter elements supported on a support element, e.g., a metal rod, that is substantially parallel to the floor of the processing chamber. The getter pump is placed directly within the processing chamber without a housing, but a substantially L-shaped thermal shield that partially surrounds the getter elements may be provided. As a result of the excellent gas conductance to the surfaces of the getter elements, this pump has high gas sorption velocity. Unfortunately, this getter pump is specifically designed for use in semiconductor processing chambers and, consequently, may not be suitable for use in other applications such as, for example, applications involving scientific instruments in which the getter pump is connected to a space to be evacuated via a suitable conduit.

In view of the foregoing, there is a need for a getter pump with high gas sorption velocity that is suitable for use in a variety of applications.

SUMMARY OF THE INVENTION

Broadly speaking, the invention fills this need by providing a getter pump in which a number of getter structures are arranged in a specific configuration to obtain high gas sorption velocity. In particular, the getter structures are arranged so that the individual getter elements of the getter structures can be efficiently heated and so that gases in the getter pump can be readily conveyed onto all the surfaces of the individual getter elements.

A getter pump in accordance with one embodiment of the invention includes a cylindrical housing that has an open end and a closed end and defines a chamber with a central axis. Three to eight getter structures are disposed within the chamber. These getter structures are symmetrically arranged around the central axis of the chamber and are substantially parallel to the central axis of the chamber. Each of the getter structures includes a plurality of porous disks of getter material disposed on a central shaft. A heater is centrally disposed within the chamber. The heater is substantially coaxial with the central axis of the chamber.

The getter pump of the invention preferably includes four to six getter structures disposed within the chamber. The housing preferably includes at least two sections that are fastened together to form a vacuum-tight seal. In one preferred embodiment, the housing includes a tubular section having a flange at each end thereof and a base fastened to the flange at one end of the tubular section.

The porous disks of getter material are preferably formed of sintered powder of a metal selected from the group consisting of titanium and zirconium. Titanium alloys containing a transition metal or aluminum and zirconium alloys containing a transition metal or aluminum are preferred, with an alloy containing 70 wt % of Zr, 24.6 wt % of V, and 5.4 wt % of Fe being most preferred. In one embodiment of the invention, the disks of getter material are formed of sintered powder of a mixture containing either titanium powder or zirconium powder and powder of an alloy selected from the group consisting of titanium alloys containing a transition metal or aluminum and zirconium alloys containing transition metal or aluminum. In one preferred embodiment, the disks of getter material are formed of sintered powder of a mixture containing 60 wt % of powder of the alloy containing 70 wt % of Zr, 24.6 wt % of V, and 5.4 wt % of Fe and 40 wt % of zirconium powder.

The getter pump of the present invention advantageously provides high gas sorption velocity because the getter structures are arranged in a specific geometry that allows gas to be readily conveyed onto all the surfaces of the individual getter elements and enables the individual getter elements to be efficiently heated. The getter pump of the present invention is further advantageous because it is configured so that it can be used in a variety of applications.

It is to be understood that the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate exemplary embodiments of the invention and together with the description serve to explain the principles of the invention.

DETAILED DESCRIPTION OF THE PREFERRED EMBODIMENTS

Figure 1:
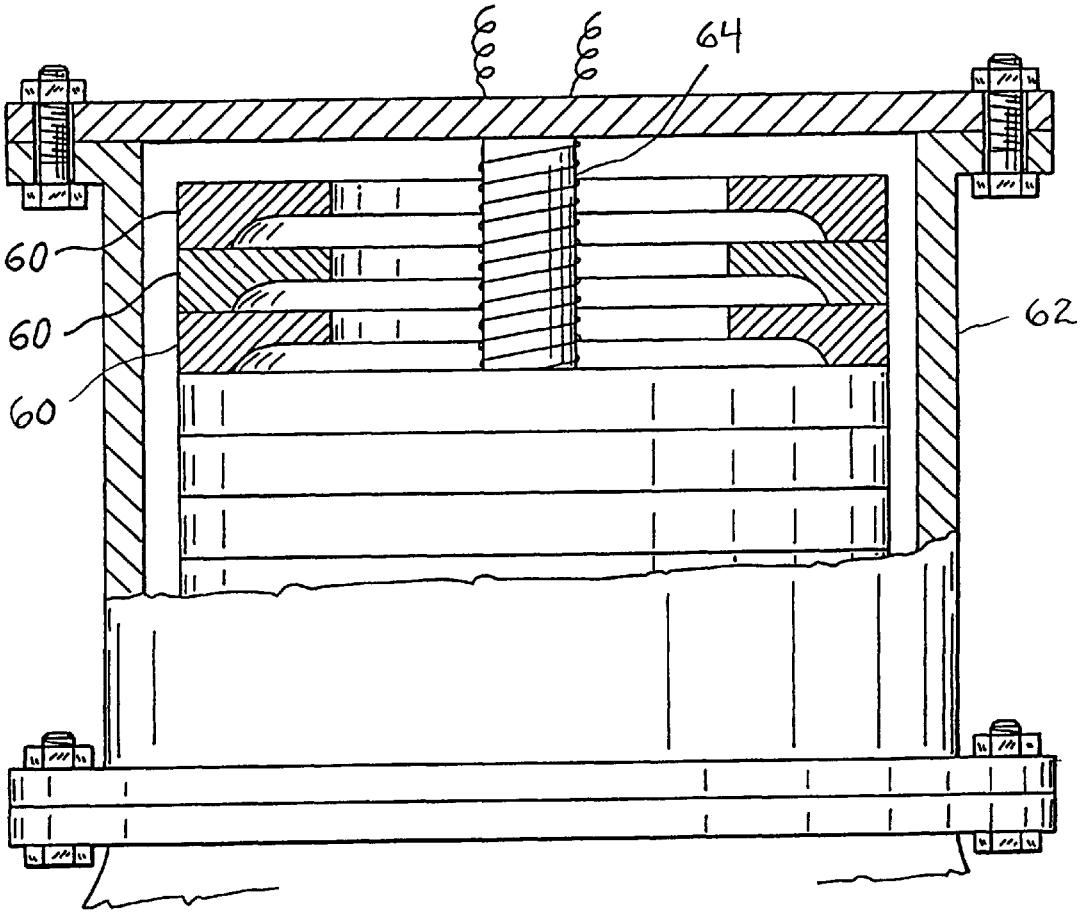
Fig. 1 PRIOR ART
FIG. 1 shows an elevational view, a portion of which is shown in cross section, of the getter pump disclosed in U.S. Pat. No. 5,320,496.
Figure 2A:
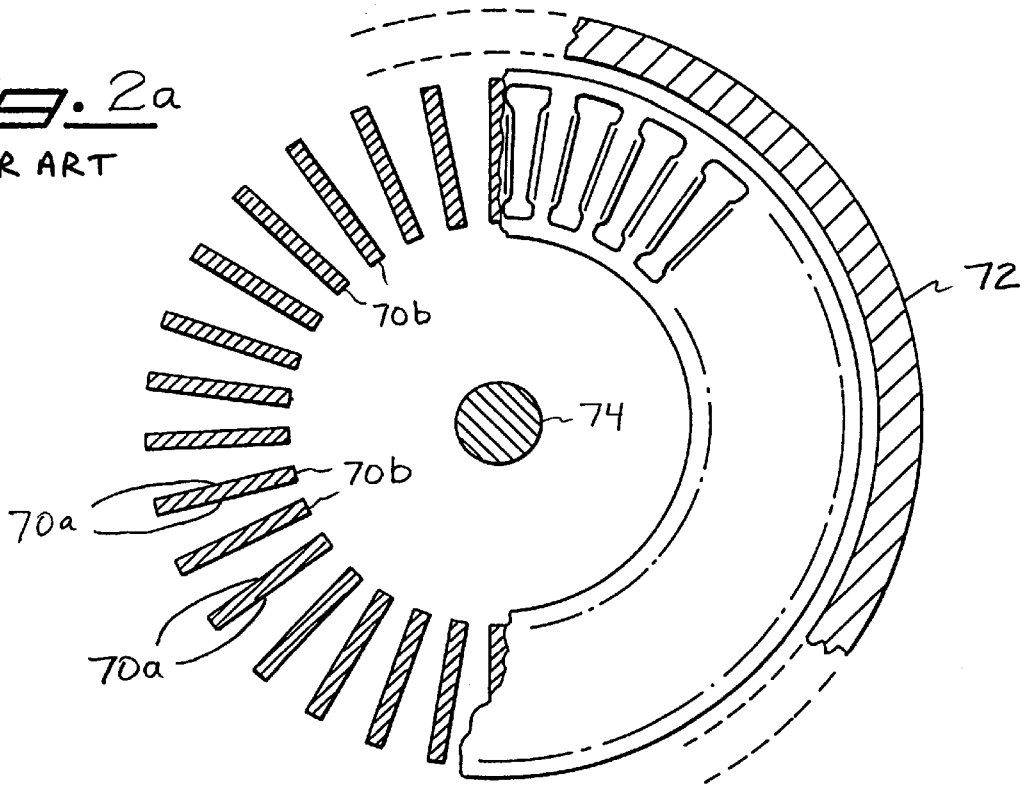
Fig. 2a PRIOR ART
FIG. 2*a* shows a top plan view, a portion of which is shown in cross section, of the getter pump disclosed in U.S. Pat. No. 5,324,172.
Figure 2B:
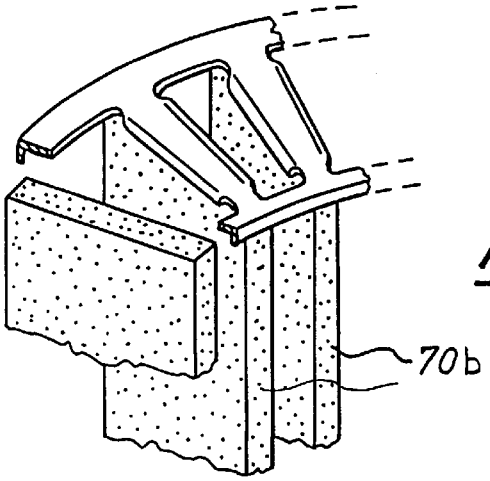
Fig. 2b PRIOR ART
FIG. 2*b* is a partial perspective view showing the details of the rectangular getter elements used in the getter pump shown in FIG. 2*a*.

Reference will now be made to the present preferred embodiments of the invention, examples of which are illustrated in the accompanying drawings. FIGS. 1, 2*a*, and 2*b* are discussed above in the "Background of the Invention" section.

Figure 3:
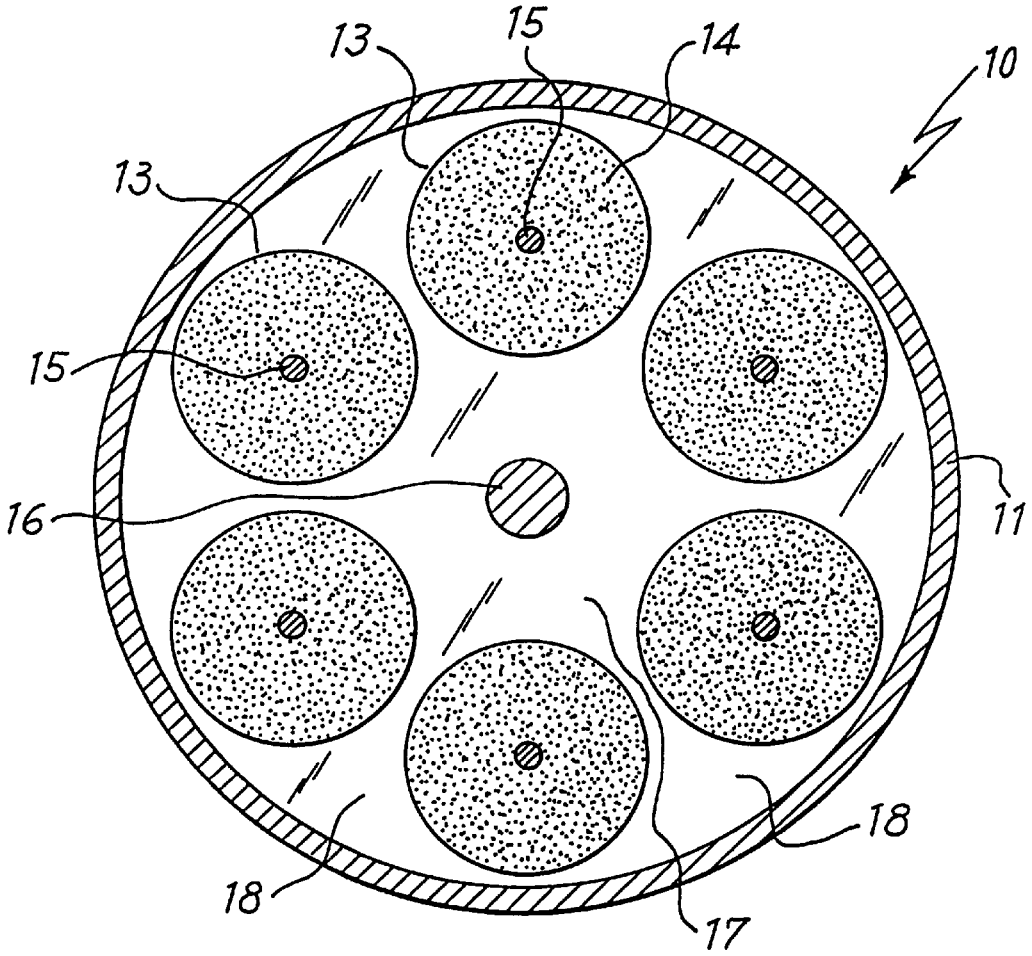
FIG. 3 shows a top plan view of a getter pump in accordance with one embodiment of the invention taken along a cross section perpendicular to the pump axis.
Figure 4:
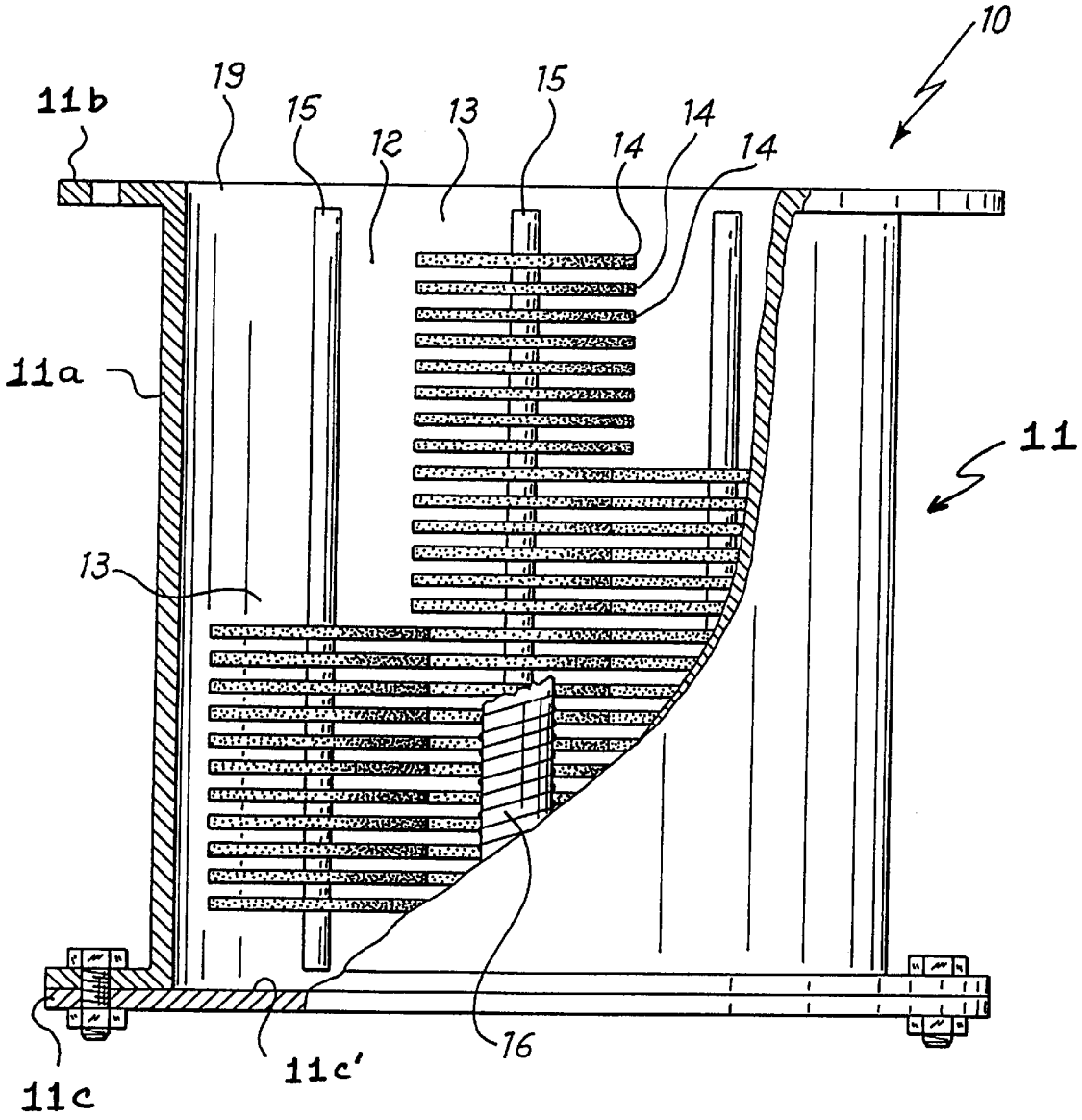
FIG. 4 shows an elevational view of the getter pump shown in FIG. 3, a portion of which is shown in cross section along a plane orthogonal to the pump axis.

FIGS. 3 and 4 show a getter pump in accordance with one embodiment of the present invention. FIG. 3 shows a top plan view of the getter pump taken on a cross section perpendicular to the pump axis. FIG. 4 shows an elevational view of the getter pump, a portion of which is shown in cross section along a plane orthogonal to the pump axis. As shown in FIGS. 3 and 4, getter pump 10 includes cylindrical housing 11 that defines a chamber 12 in which six getter structures 13 are disposed, as will be described in more detail below. For sake of clarity, only the three farthest getter structures 13 are shown in FIG. 4. Furthermore, of the three getter structures 13 shown in FIG. 4, the entire vertical development is shown only for the farthest getter structure, with partial vertical developments being shown for the other two getter structures.

With reference to FIG. 4, housing 11 includes tubular section 11*a* provided with flanges 11*b* at each end thereof. Base 11*c*, which is generally circular, is fastened to flange 11*b* at the lower end of tubular section 11*a* with suitable connectors, e.g., nuts and bolts, to close the lower end of tubular section 11*a*. Suitable gaskets (not shown) are preferably provided between flange 11*b* and base 11*c* to obtain a vacuum-tight seal. The gaskets may be made of either a polymeric material or a metallic material depending on the desired vacuum level as is well known to those skilled in the art. The upper end of tubular section 11*a*, i.e., the end opposite base 11*c*, remains open and forms open end 19 of housing 11. Flange 11*b* at the upper end of tubular section 11*a* may be used to connect getter pump 10 directly to a space to be evacuated, e.g., a chamber, or to suitable counterflanges associated with piping used to connect pump 10 to the space to be evacuated, as will be described in more detail below. Housing 11 may be made of metal, preferably AISI 304L or 316L stainless steel.

As shown in FIGS. 3 and 4, six getter structures 13 are disposed in chamber 12. These six getter structures 13 are symmetrically arranged around the central axis of chamber 12 (see FIG. 3). Heater 16 is centrally disposed within chamber 12 and preferably is substantially coaxial with the central axis of the chamber. As shown in FIG. 4, heater 16 is a resistance heater formed by helically winding a metal wire around a ceramic support. Alternatively, heater 16 may be a lamp, e.g., a quartz lamp. The symmetrical arrangement of getter structures 13 around the central axis of chamber 12 creates a void volume 17 in the central region of the pump and a series of void volumes 18 in the peripheral region of the pump between adjacent getter structures. Void volume 17 and void volumes 18, all of which extend for substantially the entire height of the pump, are significant in obtaining high gas sorption velocity because they provide conductances for conveying gas onto the surfaces of the getter material.

With reference to FIG. 4, each getter structure 13 includes a plurality of porous disks 14 of getter material disposed on central shaft 15, which is preferably formed of the same material used to form housing 11. The disks 14 are spaced apart from one another on shaft 15 by spacing members (not shown). The spacing members may be metal ringlets that are either integral with disks 14 or separate therefrom. Alternatively, each disk 14 may be provided with a central portion that has a thicker cross-section than the remainder of the disk and thereby serves as a spacing member.

Getter structures 13 may be held in the desired symmetrical arrangement within chamber 12 using techniques known to those skilled in the art. For example, getter structures 13 may be mounted on one or more metal sections (not shown) and then introduced into chamber 12. Alternatively, inner surface 11*c*' of base 11*c* (see FIG. 4) may be provided with suitable seats (not shown) for securing the ends of central shafts 15. Other suitable techniques for holding getter structures in the desired configuration within chamber 12 will be apparent to those skilled in the art.

Porous disks 14 of getter material may be formed by sintering powdered getter material in accordance with known techniques. Suitable getter materials include, but are not limited to, titanium alloys and zirconium alloys. Preferred titanium alloys and zirconium alloys include such alloys containing a transition metal or aluminum. Commercially available NEG materials produced by SAES Getters S.p.A. of Lainate, Italy, the assignee of the present application, that are well suited for use in getter pumps include the alloys sold under the trade names St 707™ and St 172™. The St 707™ alloy has a composition of 70 wt % Zr, 24.6 wt % V, and 5.4 wt % Fe. The St 172™ alloy contains 60 wt % of the St 707™ alloy and 40 wt % of zirconium. In one embodiment of the invention porous disks 14 of getter material are formed by sintering a mixture containing zirconium powder and powder of a zirconium alloy containing a transition metal or aluminum. In another embodiment of the invention porous disks 14 of getter material are formed by sintering a mixture containing titanium powder and powder of a titanium alloy containing a transition metal or aluminum. A preferred process by which porous disks 14 of getter material may be produced is disclosed in European Patent Publication No. EP 0 719 609 A2, the disclosure of which is incorporated herein by reference.

Figure 5:
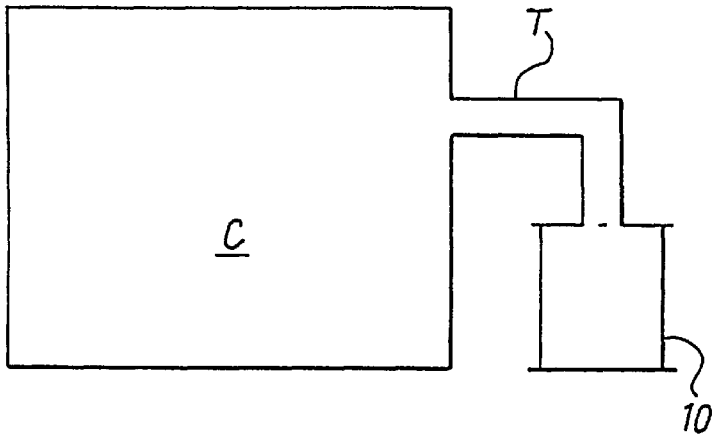
FIG. 5 is a schematic diagram showing the getter pump of the invention connected to a chamber to be evacuated by piping in accordance with one embodiment of the invention.
Figure 6:
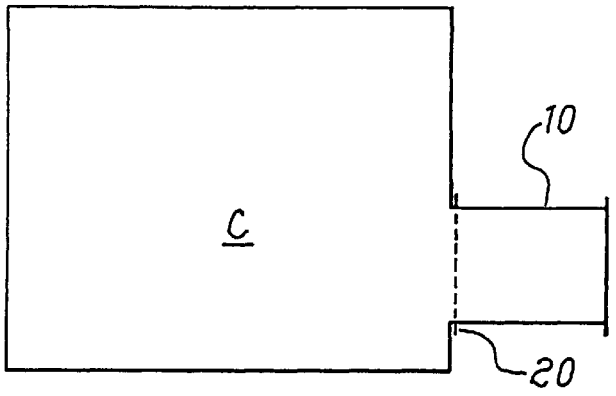
FIG. 6 is a schematic diagram showing the getter pump of the invention directly connected to a chamber to be evacuated in accordance with another embodiment of the invention.
Figure 7:
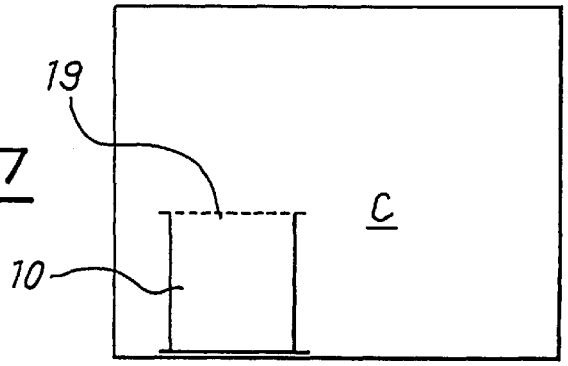
FIG. 7 is a schematic diagram showing the getter pump of the invention disposed within a chamber to be evacuated in accordance with yet another embodiment of the invention.

FIGS. 5 to 7 show exemplary configurations in which the getter pump of the invention may be used. FIG. 5 shows getter pump 10 connected to chamber C to be evacuated through piping T. As discussed above in connection with the description of FIG. 4, piping T may be connected to flange 11*b* at the upper end of tubular section 11*a*. Piping T may be made of metal and, if desired, may be jointed, as is well known to those skilled in the art. FIG. 6 shows getter pump 10 directly connected to chamber C to be evacuated through flange 11*b* at the upper end of tubular section 11*a*. FIG. 7 shows getter pump 10 disposed within chamber C to be evacuated. In this configuration open end 19 remains open because flange 11*b* at the upper end of tubular section 11*a* is not used and housing 11 acts as a shield for preventing particles of getter material from moving through chamber C.

In accordance with the invention, the number of getter structures disposed within the chamber may be in the range from three to eight, and preferably in the range from four to six. When the number of getter structures is fewer than three, the void volumes in the peripheral portion of the getter pump between the getter structures are excessive while space in the central portion of the pump for the heater is restricted. When the number of getter structures is greater than eight, the void volume in the central portion of the pump is excessive and, assuming the overall pump size is the same, results in a reduction of the volume of getter material and reduces the heating efficiency of the heater. Thus, the use of three to eight, and preferably four to six, getter structures provides the best compromise between the mutual distances of the getter structures and their distance from the heater, as well as between the volume of getter material and the volume of the conductances in the central portion of the getter pump and in the peripheral portion of the getter pump between adjacent getter structures.

EXAMPLES

The getter pump of the invention will now be described in terms of specific examples. These examples illustrate preferred embodiments of the getter pump of the invention and are included herein to explain the principles of the invention to those skilled in the art. It is therefore to be understood that the following examples are merely illustrative and should in no way be construed as limiting the getter pump of the invention to any particular configuration or application.

EXAMPLE 1

Figure 8:
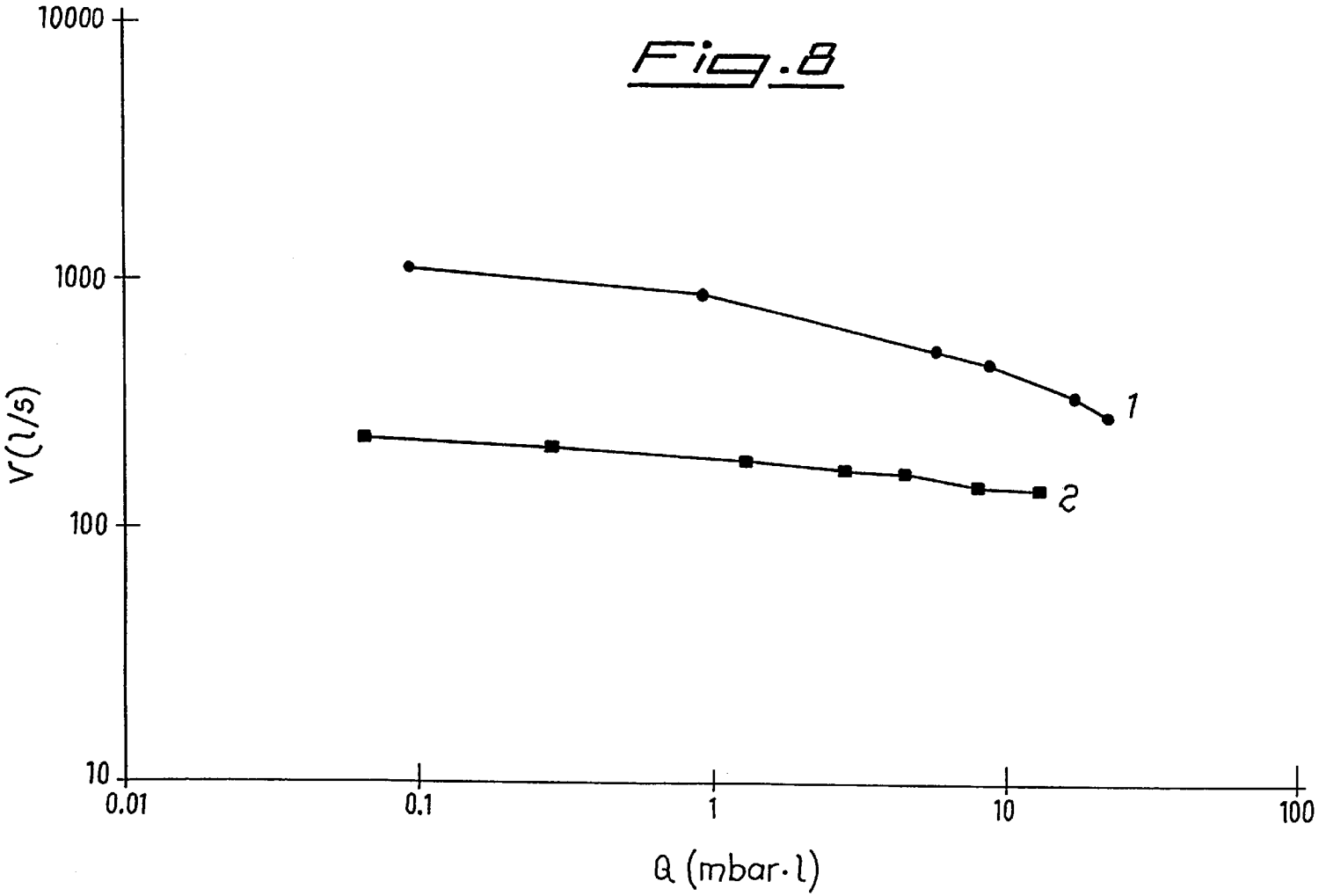
FIG. 8 is a graph of gas sorption velocity (V), measured in liters per second (l/s), as a function of the amount of sorbed gas (Q), measured in mbar per liter (mbar•l), for the getter pump of the invention and a conventional getter pump.

A getter pump in accordance with the invention was assembled. The getter pump was formed of a housing that defined a cylindrical chamber having a height of 135 mm and an inner diameter of 92 mm, with the upper portion of the housing being open. Six getter structures, each having 50 disks of getter material with a diameter of 2.54 cm, were disposed in the chamber. The disks of getter material were formed of sintered powder of the above-described St 172™ alloy. As observed from the upper opening of the housing, the six getter structures appeared to be inscribed in an annulus such that a void volume having a diameter of 31 mm was formed at the center of the pump and each getter structure was about 3 mm from the inner wall of the housing. A quartz lamp for heating the getter structures was disposed in the central portion of the pump. A gas sorption velocity test was carried out in accordance with the ASTM F 798-82 standard at a temperature of 250° C. using CO as the test gas. The test results are shown in double logarithmic scale in FIG. 8 as curve 1. FIG. 8 is a graph of gas sorption velocity (V), measured in liters per second (l/s), as a function of the amount of sorbed gas (Q), measured in mbar per liter (mbar•l).

COMPARATIVE EXAMPLE 2

The gas sorption velocity test of Example 1 was repeated using a getter pump having the same dimensions and materials as the pump described in Example 1, except that the getter material was provided in sheet form as disclosed in the above-discussed '172 patent (see FIGS. 2*a* and 2*b*) instead of in the form of stacked disks. As observed from the upper opening of the housing, the sheets of getter material appeared to be arranged in an annulus having the same dimensions as the pump of Example 1. The results of this gas sorption velocity test are shown as curve 2 in FIG. 8.

A comparison of curves 1 and 2 shown in FIG. 8 reveals that at the onset of gas sorption the getter pump of the invention has a gas sorption velocity about five times greater than the getter pump shown in the '172 patent. As mentioned above, the getter pump shown in the '172 patent does not provide optimal gas sorption velocity because only narrow surfaces 70*b* (see FIG. 2*b*) of the rectangular getter elements are directly heated, which results in inefficient heating of the getter elements. In contrast, in the getter pump of the invention, the portion of each getter element that is directly heated is much larger than that in the getter pump shown in the '172 patent. In particular, in the getter pump of the invention, the portion of the surface of each getter element that is directly exposed to radiation from the heater is equal to about half the circumference of the disk multiplied for its thickness. This increased exposure results in more efficient heating of the getter elements and, consequently, increased gas sorption velocity.

In addition to efficient heating of the getter elements, the specific geometry of the getter pump of the invention also contributes to increased gas sorption velocity by providing high gas conductances within the chamber. Specifically, as shown in FIG. 3, the void volume 17 in the central portion of the pump and the void volumes 18 in the peripheral portion of the pump between adjacent getter structures 13 enables easy access of gases to the surfaces of disks 14 of getter material. In contrast, in the getter pump shown in the above-discussed '496 patent, there is reduced gas conductance in the region between the inner wall of housing 62, which defines a chamber, and the stack of getter elements 60 (see FIG. 1). As such, the outermost surfaces of getter elements 60 (relative to the center of the chamber) are not readily accessible to gases in the chamber, which causes the gas sorption velocity of the getter pump shown in the '496 patent to be lower than that of the getter pump of the invention.

It will be apparent to those skilled in the art that various modifications may be made to the exemplary getter pump of the invention shown in FIGS. 3 and 4. For example, housing 11 may be formed as a one-piece housing, e.g., by welding tubular section 11*a* and base 11*c* together. In most applications, however, the use of a two-piece housing as shown herein is preferable because it enables pump maintenance operations, e.g., replacement of the getter structures or heater, to be carried out relatively easily by removing base 11*c* from tubular section 11*a*. In addition, the number of getter structures that may be used is not limited to six but instead, as mentioned above, may be any number in the range from three to eight.

In summary, the present invention provides a getter pump in which the getter structures are arranged in a specific configuration that allows gas to be readily conveyed onto all the surfaces of the individual getter elements and enables the individual getter elements to be efficiently heated. As a result of this specific configuration, the getter pump of the invention has high gas sorption velocity. The invention has been described herein in terms of several preferred embodiments. Other embodiments of the invention will be apparent to those skilled in the art from consideration of the specification and practice of the invention. For example, as mentioned above, the housing may be formed as a one-piece housing and the number of getter structures may be varied within the range from three to eight. The embodiments and preferred features described above should be considered exemplary, with the invention being defined by the appended claims.

What is claimed is:

1. A getter pump with high gas sorption velocity, comprising:

a cylindrical housing having an open end and a closed end, said housing defining a chamber with a central axis;

three to eight getter structures disposed within said chamber, said getter structures being symmetrically arranged around said central axis of said chamber and substantially parallel to said central axis of said chamber, each of said getter structures being comprised of a plurality of porous disks of getter material disposed on a central shaft; and a heater centrally disposed within said chamber, said heater being substantially coaxial with said central axis of said chamber.

2. The getter pump of claim 1, wherein four to six getter structures are disposed within said chamber.

3. The getter pump of claim 1, wherein the housing comprises at least two sections that are fastened together to form a vacuum-tight seal.

4. The getter pump of claim 3, wherein the housing comprises a tubular section having a flange at each end thereof and a base fastened to said flange at one end of said tubular section.

5. The getter pump of claim 1, wherein the disks of getter material comprise sintered powder of a metal selected from the group consisting of titanium and zirconium.

6. The getter pump of claim 1, wherein the disks of getter material comprise sintered powder of an alloy selected from the group consisting of titanium alloys containing a transition metal or aluminum and zirconium alloys containing a transition metal or aluminum.

7. The getter pump of claim 1, wherein the disks of getter material comprise sintered powder of a mixture containing one of titanium powder and zirconium powder and powder of an alloy selected from the group consisting of titanium alloys containing a transition metal or aluminum and zirconium alloys containing transition metal or aluminum.

8. The getter pump of claim 1, wherein the disks of getter material comprise sintered powder of an alloy containing 70 wt % of Zr, 24.6 wt % of V, and 5.4 wt % of Fe.

9. The getter pump of claim 1, wherein the disks of getter material comprise sintered powder of a mixture containing powder of an alloy containing 70 wt % of Zr, 24.6 wt % of V, and 5.4 wt % of Fe and zirconium powder.

10. The getter pump of claim 9, wherein the mixture contains 60 wt % of the alloy containing 70 wt % of Zr, 24.6 wt % of V, and 5.4 wt % of Fe and 40 wt % of zirconium powder.

11. A getter pump with high gas sorption velocity, comprising:

a housing comprising a tubular section having a flange at each end thereof and a base fastened to said flange at one end of said tubular section, said housing defining a chamber with a central axis;

three to eight getter structures disposed within said chamber, said getter structures being symmetrically arranged around said central axis of said chamber and substantially parallel to said central axis of said chamber, each of said getter structures being comprised of a plurality of porous disks of getter material disposed on a metal shaft; and a heater centrally disposed within said chamber, said heater being substantially coaxial with said central axis of said chamber.

12. The getter pump of claim 11, wherein four to six getter structures are disposed within said chamber.

13. The getter pump of claim 11, wherein the heater is a quartz lamp.

14. The getter pump of claim 13, wherein the housing and the metal shaft are comprised of stainless steel.

15. The getter pump of claim 11, wherein the base is fastened to the flange at one end of the tubular section to form a vacuum-tight seal.

16. The getter pump of claim 11, wherein the disks of getter material comprise sintered powder of a metal selected from the group consisting of titanium and zirconium.

17. The getter pump of claim 11, wherein the disks of getter material comprise sintered powder of an alloy selected from the group consisting of titanium alloys containing a transition metal or aluminum and zirconium alloys containing a transition metal or aluminum.

18. The getter pump of claim 11, wherein the disks of getter material comprise sintered powder of an alloy containing 70 wt % of Zr, 24.6 wt % of V, and 5.4 wt % of Fe.

19. The getter pump of claim 11, wherein the disks of getter material comprise sintered powder of a mixture containing powder of an alloy containing 70 wt % of Zr, 24.6 wt % of V, and 5.4 wt % of Fe and zirconium powder.

20. The getter pump of claim 19, wherein the mixture contains 60 wt % of the alloy containing 70 wt % of Zr, 24.6 wt % of V, and 5.4 wt % of Fe and 40 wt % of zirconium powder.

21. The getter pump of claim 11, wherein the disks of getter material comprise sintered powder of a mixture containing one of titanium powder and zirconium powder and powder of an alloy selected from the group consisting of titanium alloys containing a transition metal or aluminum and zirconium alloys containing transition metal or aluminum.

22. The getter pump of claim 7, wherein the disks of getter material comprise sintered powder of a mixture containing powder of an alloy containing 84 wt % of Zr and 16 wt % of Al and zirconium powder.

23. The getter pump of claim 22, wherein the mixture contains 60 wt % of the alloy containing 84 wt % of Zr and 16 wt % of Al and 40 wt % of zirconium powder.

24. The getter pump of claim 21, wherein the disks of getter material comprise sintered powder of a mixture containing powder of an alloy containing 84 wt % of Zr and 16 wt % of Al and zirconium powder.

25. The getter pump of claim 24, wherein the mixture contains 60 wt % of the alloy containing 84 wt % of Zr and 16 wt % of Al and 40 wt % of zirconium powder.

* * * * *